US006860086B2

(12) United States Patent
Rosloot et al.

(10) Patent No.: US 6,860,086 B2
(45) Date of Patent: Mar. 1, 2005

(54) PACKAGING APPARATUS AND METHOD FOR THE USE OF A PACKAGING APPARATUS

(75) Inventors: Wilhelmus Johannes Rosloot, Alkmaar (NL); Roberto Tuyn, Zaanstad (NL)

(73) Assignee: Buhrs-Zaandam B.V., Zaandam (NL)

( * ) Notice: Subject to any disclaimer, the term of this patent is extended or adjusted under 35 U.S.C. 154(b) by 0 days.

(21) Appl. No.: 10/317,136

(22) Filed: Dec. 12, 2002

(65) Prior Publication Data

US 2003/0106286 A1 Jun. 12, 2003

(30) Foreign Application Priority Data

Dec. 12, 2001 (NL) ..... 1019545
Jul. 31, 2002 (NL) ..... 1021193

(51) Int. Cl.[7] ..... B65B 53/00; B65B 9/06

(52) U.S. Cl. ..... 53/441; 53/450; 53/550; 53/556

(58) Field of Search ..... 53/441, 450, 550, 53/556, 51, 64, 504, 75

(56) References Cited

U.S. PATENT DOCUMENTS

| | | | | | |
|---|---|---|---|---|---|
| 2,597,041 | A | * | 5/1952 | Stokes | 53/556 |
| 3,589,091 | A | | 6/1971 | Cloud | |
| 3,916,597 | A | * | 11/1975 | Martelli | 53/450 |
| 4,144,697 | A | * | 3/1979 | Suga | 53/556 |
| 4,441,664 | A | * | 4/1984 | Stohlquist | 242/421.8 |
| 4,571,927 | A | * | 2/1986 | Suga | 53/556 |
| 4,872,302 | A | | 10/1989 | van Eijsden et al. | |
| 5,237,800 | A | * | 8/1993 | Omori | 53/450 |
| 5,285,621 | A | | 2/1994 | Ballestrazzi et al. | |
| 5,299,410 | A | * | 4/1994 | Freeman | 53/504 |
| 5,341,623 | A | * | 8/1994 | Siegel | 53/450 |
| 5,347,791 | A | * | 9/1994 | Ginzl et al. | 53/450 |
| 5,524,420 | A | * | 6/1996 | Ikuta | 53/450 |
| 5,566,526 | A | * | 10/1996 | Suga | 53/550 |
| 5,653,085 | A | * | 8/1997 | Suga | 53/550 |
| 5,689,942 | A | * | 11/1997 | Suga | 53/550 |
| 5,755,082 | A | * | 5/1998 | Takahashi et al. | 53/550 |
| 6,050,057 | A | * | 4/2000 | Tuyn et al. | 53/550 |
| 6,354,064 | B1 | * | 3/2002 | Meetze et al. | 53/450 |

FOREIGN PATENT DOCUMENTS

| | | | | |
|---|---|---|---|---|
| EP | 0 537 844 A1 | | 4/1993 | |
| EP | 0 537 844 B1 | | 1/1996 | |
| EP | 0 870 678 A1 | | 10/1998 | |
| GB | 2233305 A | * | 1/1991 | B65B/9/06 |

* cited by examiner

*Primary Examiner*—Stephen F. Gerrity
(74) *Attorney, Agent, or Firm*—Birch, Stewart, Kolasch & Birch, LLP

(57) ABSTRACT

A method and packaging apparatus for packaging products starting from a continuous packaging web which moves uninterruptedly and wherein the web is formed into a package tube and, by the application of cross seals, is divided in separate packaged products. Prior to its folding, the film web is then stretched for obtaining, after application of the cross seals, a shrinkback effect. Due to this shrinkback effect, a tight-fitting package is obtained. The invention particularly relates to the manner in which the stretching of the film web is controlled, so that a good reproducible shrinking effect is obtained without the film web being subjected to undesired loads.

17 Claims, 10 Drawing Sheets

PACKAGING APPARATUS AND METHOD FOR THE USE OF A PACKAGING APPARATUS

CROSS-REFERENCE TO RELATED APPLICATIONS

This nonprovisional application claims priority under 35 U.S.C. § 119(*a*) on Patent Application No. 1019545 filed in THE NETHERLANDS on Dec. 12, 2001, which is herein incorporated by reference.

BACKGROUND OF THE INVENTION

1. Field of the Invention

The invention relates to a method for the use of a packaging apparatus.

The invention also relates to a packaging apparatus for practicing the method.

2. Description of Background Art

Such a method and apparatus are known from U.S. Pat. No. 3,589,091. In particular FIG. 14 and the passage in column 8, lines 27–63 thereof show and describe an apparatus with which products are packaged in a film which is supplied in a continuous web and which is stretched before the film is folded around the articles to be packaged. For the purpose of stretching the film, two pairs of drawing rollers 161, 162 are used, while one pair of drawing rollers located downstream are rotated at a higher speed than the pair of drawing rollers located upstream. What is thus achieved according to the US patent, is that the film is stretched. However, the US patent does not clarify in what manner the film web is supplied and in what manner the degree of stretching is determined. Without an accurate control of the transport of the film web downstream of the pair of drawing rollers and upstream of the pair of drawing rollers, with time, the film web will break or, conversely, sag upstream or downstream of, or between the pairs of drawing rollers.

Another drawback of the known apparatus and method is that the film shrinking back already occurs after the film has passed the downstream pair of drawing rollers 162. In particular when the film is supplied from below and is guided over a film guiding element for bringing the film in a horizontal plane, shrinking causes an irregular run, leading to tracking problems. Also when the apparatus is stopped, the film downstream of the downstream pair of drawing rollers 162 will have ample time to shrink back. What this leads to is that the first packages which are processed after restarting of the apparatus will not be tight-fitting packages, or that they can even be damaged.

The present invention contemplates a practical solution to these problems.

In practice, the packaging apparatuses marketed hitherto by applicant and the method utilized therewith yield packages in which the products are loosely enveloped by the film package. To the present day, with these known apparatuses, only one pair of drawing rollers was used for unrolling the film web from the film web roll. With the packaging apparatuses marketed by applicant, the loosely enveloping packages are the result of the fact that the cross sealing device is provided with sealing bars having a particular width, so that the products present in the package tube must be spaced at a particular distance from each other. Moreover, the cross seal has to be applied while the package tube moves in the transport direction at a speed of approximately 1.5 meters per second. That is why a space of almost 30 mm is required between two successive products plus the thickness of the product. All this results in two flaps at the end faces of the products, having a length of approximately 15 mm. Such flaps cause problems in the sorting machines of the postmen and, what is more, a non-tight-fitting package is less esthetic than a package in which the product is received in a tight-fitting manner.

To solve these problems, often, downstream of the packaging apparatus, a so-called shrink tunnel was utilized. In such a shrink tunnel, the packaged products are exposed to a high temperature under the influence of which the packaging film shrinks. Drawbacks of this known solution are that a shrink tunnel requires a high investment, that the use of the shrink tunnel demands a lot of energy and that, generally, shrink tunnels take up much space in a production facility, which is undesired. Moreover, special shrink film has to be utilized which is relatively expensive.

The apparatus known from the US patent forms a possible solution to the problems of too loose-fitting packages, that is, by stretching the film prior to folding. However, this known solution has the associated drawbacks already described.

SUMMARY OF THE INVENTION

An embodiment of the present invention contemplates a method and a packaging apparatus, in which each time, substantially the same shrinking effect is realized without the film web breaking or starting to sag or being undesirably loaded in a different manner, while, moreover, tracking problems due to irregular shrinkage behind the downstream pair of drawing rollers is prevented and wherein, also, the starting problems described are solved.

According to a first aspect of the method of the present invention, the packaging apparatus is provided with folding means for bringing the longitudinal edges of a continuous moving film web towards each other, the two longitudinal edges, brought towards each other, overlapping for forming a continuous package tube, while downstream of the folding means a cross sealing device is provided with the aid of which, transversely to the transport direction, cross seals are provided in the package tube, while upstream of the folding means with the aid of two pairs of drawing rollers the film is stretched such that after application of the cross seals, the film still shrinks in longitudinal direction in order that packages are obtained in which the cross seals substantially abut against the products packaged therein, so that the package extends relatively tight-fittingly around the products, wherein the film web is unwound from a film web roll which is placed on a roll holder of the packaging apparatus, while downstream of the two pairs of drawing rollers the film web is guided in a horizontal plane over a conveyor belt whose transport speed, in use, substantially corresponds to the speed of movement of the film in said horizontal plane, while above said conveyor belt, directly, or at a limited distance upstream from the cross sealing device, a pulling device is arranged which engages the package tube at the location of the overlapping edges, while also between the downstream pair of drawing rollers and the pulling device with the aid of the pulling device, the film is held in a stretched condition.

As the film is also kept in a stretched condition between the downstream pair of drawing rollers and the pulling device, and, therefore, a tensile force is applied to the film, the tracking problems in the path downstream of the film guiding element are solved. Moreover, stopping the apparatus does not lead, after restarting the apparatus, to a number packages being obtained which are not tight-fitting.

The fact is that the products which lie on the film web extending between the film guiding element and the pulling device, lie on a stretched film web, which stretched film web can only shrink back after it has passed the pulling device. As the pulling device is arranged directly, or at a small distance, upstream of the cross sealing device, there is not any product which, during standstill of the apparatus, is present on a film web part which has the opportunity to shrink back.

Primarily, there is the tendency to, each time, obtain the same shrinking effect by applying an adjustable force to the film web roll or to the film web with the aid of a brake or drawing rollers. In doing so, there is the tendency to adjust the tensile force applied by means of a force measurement or the like. However, extensive experiments have shown that for a particular shrinkback length, each time, a different force is required to effect this shrinkback length. Of influence are inter alia, the film width, film thickness and the film type. Even within one run with the same film web, a different degree of shrinkback occurred at an equal application of force. Therefore, the conclusion of the experiments was that force measurement on a film web is not suitable for setting the desired degree of shrinkback.

According to a second aspect of the method of the present invention, the upstream pair of drawing rollers, the downstream trailing pair of rollers as well as the conveyor belt and the pulling device are driven by a controllable drive, which drives are mutually coupled by the control modules, which control modules control the mutual positions of the drives such that between the pairs of drawing rollers a desired stretch of the film is realized and that between the downstream pair of rollers and the pulling device a particular degree of stretch of the film is maintained.

With such a position control of the two pairs of drawing rollers, and of the pulling device with the conveyor relative to each other, an extremely accurately reproducible shrinking effect is achieved which will not or hardly vary during one run with a single film web. This in contrast to a control based on force measurement for determining the tensile stress in the film.

According to a third aspect of the method of the present invention, the film web is guided over a film guiding element for bringing this film into the horizontal plane of the conveyor belt, the film guiding element being designed as a tube provided with small holes, the tube being connected to a compressed air device such that compressed air flows out of the small holes and the friction between the film guiding element and the film web is minimized. It will be clear that, as a result of the method according to the invention, the friction experienced by the film web at the location of the film guiding element increases as a result of the tensile stress prevailing in the film web. With the film guiding element according to the third aspect of the present invention, the friction is reduced to a great extent. This not only leads to a lower energy consumption of the apparatus but, more importantly, to far fewer problems during start-up. The stick/slip problems usually occurring during start-up are substantially prevented with the film guiding element according to the third aspect of the present invention.

According to a fourth aspect of the method of the present invention, downstream of the film guiding element a sensor detects a register mark applied to the film web and, upon detection of the register mark, passes on a signal to a control, while the control controls the drives via the control modules such that the register mark is positioned relative to the products to be packaged in the desired manner. The advantage of positioning the sensor downstream of the film guiding element is that in that path, the film experiences no, or hardly any, stretch or shrink. There, the film is in a stable condition, so that drift of the register mark relative to the products present on the film in that path will not, or hardly, occur.

According to a fifth aspect of the method of the present invention, a control is provided with an input provision, wherein, via the input provision, an operator enters the desired package length before shrink-back and the degree of shrinkage and, optionally, a desired overstretch or understretch, or enters the packaging material, while this inputted package length, degree of shrinkage and optional overstretch or understretch is also an input signal of a control module.

With such an input screen, the operator can effect the desired shrinkage in a simple manner.

A practical method for adjusting the mutual positions of the drives according to the present invention includes, for determining the rotation of the first pair of drawing rollers, the second pair of drawing rollers as well as the conveyor belt and the pulling device, controlling the respective drives by the control modules with the aid of pulses, the ratio between the number of pulses given off to the various motors being always kept constant.

According to a further elaboration of the present invention, the lengthening of the film web relative to the original length can be in the range of 5% to 30%, preferably in the range of 5% to 15%.

A film which is eminently suited to the method according to the present invention is a film from Low Density Polyethylene.

Such a film does not exhibit undesirable effects under the influence of the lengthening but maintains its attractive transparency.

The packaging apparatus according to the present invention includes folding means for bringing the longitudinal edges of the film web towards each other, the two longitudinal edges overlapping for forming a continuous package tube, and provided with a cross sealing device located downstream of the folding means, with the aid of which cross seals extending transversely to the transport direction are provided in the package tube, a second pair of drawing rollers located upstream of the folding means and a first pair of drawing rollers located upstream of the second pair of drawing rollers for, viewed in the direction of movement of the film web before the folding means, extending the film in longitudinal direction, such that after application of the cross seals the film still shrinks in longitudinal direction in order that packages are obtained in which the cross seals substantially abut against the products packaged therein, so that the package extends relatively tight-fittingly around the products, characterized in that the apparatus is further provided with an unwinder onto which a film web roll can be placed, a conveyor belt whose transport speed, in use, substantially corresponds to the speed of movement of the film in the respective transport plane, wherein above said conveyor belt, directly or at a limited distance, upstream from the cross sealing device, a pulling device is arranged which engages the package tube at the location of the overlapping longitudinal edges, wherein the first pair of drawing rollers is provided with a first drive, wherein the second pair of drawing rollers is provided with a second drive, wherein the conveyor belt and/or the pulling device are provided with at least a third drive, wherein a control is provided with control modules arranged for controlling the mutual positions of the respective drives, such that not only between the pairs of drawing rollers a stretch is realized but also between the second pair of drawing rollers and the pulling device a particular degree of stretch is maintained.

With such a packaging apparatus, the advantages which are described for the method are obtained in an advantageous manner.

Due to the mutual dependency of the various drives, with relatively simple means the fact being that measuring wheels, encoders or means for measuring the web tension during stretching or the like are not necessary—a highly accurately reproducible shrinking effect is obtained.

The invention also relates to a packaging line comprising a packaging apparatus according to the invention, while upstream of the film guiding element a product-assembling device is provided, comprising a number of feeders and a product conveyor, the feeders being arranged for feeding subproducts to the product conveyor for forming multi-layered products often consisting of a number of subproducts, while upstream of the packaging apparatus and downstream of the product-assembling device, a product-positioning station is provided for positioning, in a controlled manner, the products fed by the product-assembling device on the film web in the packaging apparatus.

As such, the above-mentioned product-assembling devices and the product-positioning stations are known and, for a great many years already, marketed by applicant. Naturally, the use of the packaging apparatus according to the invention in such a line offers the great advantage that film-wrapped products are obtained whose film package fits closely around the products accommodated therein. Optionally, downstream of the packaging apparatus, a stacking station can be arranged for stacking the packaged products. The packaged products can, for instance, comprise graphical products such as magazines and newspapers.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

Further elaborations of the packaging apparatus are described in the subclaims. The method, the packaging apparatus and the packaging line will be further elucidated with reference to two exemplary embodiments, wherein:

DETAILED DESCRIPTION OF THE PREFERRED EMBODIMENTS

Figure 1:
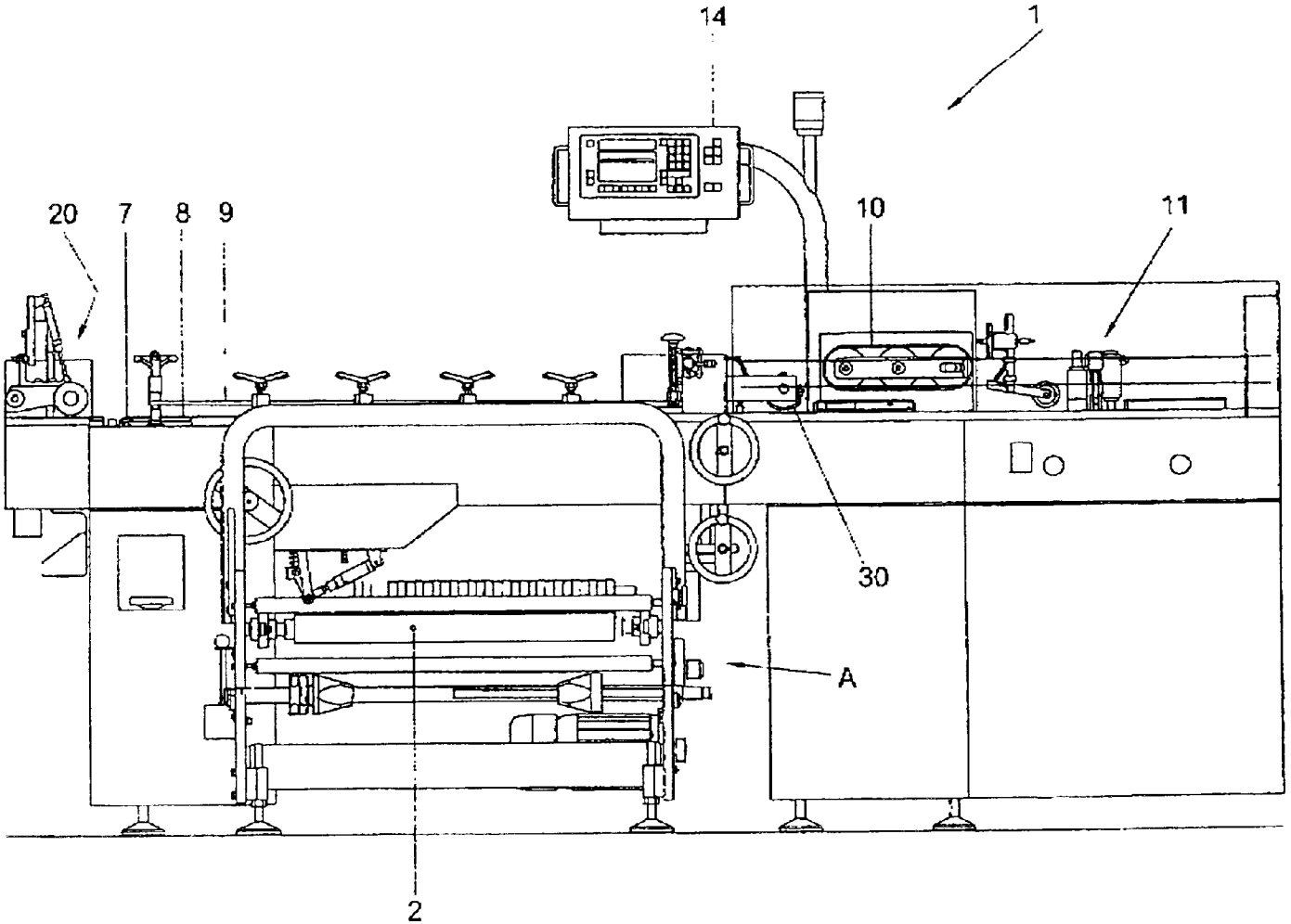
FIG. 1 shows a side view of a packaging apparatus according to the state of the art.

The present invention will now we described with reference to the accompanying drawings, wherein the same or similar elements have been identified by the same reference numeral throughout the several views.

Figure 2:
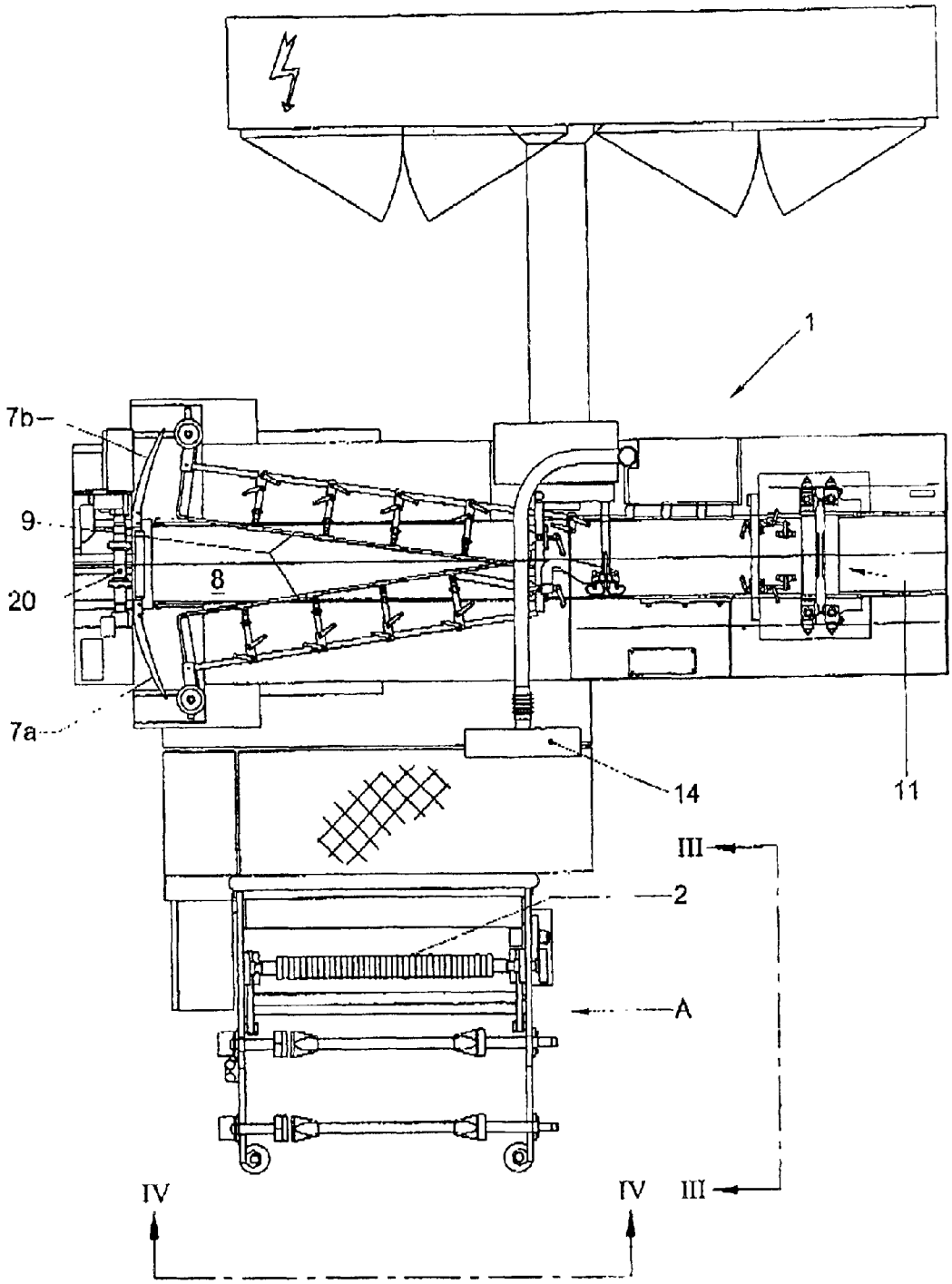
FIG. 2 shows a top plan view of the packaging apparatus represented in FIG. 1.

FIGS. 1 and 2 show an example of a packaging apparatus according to the state of the art. The known apparatus is provided with an unwinder A onto which a film web roll can be placed. From the film web roll, a film web to be unwound is guided via guiding means to a film guiding element 7. In the examples of the state of the art which are represented in FIGS. 1 and 2, these guiding means are not visible but they comprise in any case a pair of drawing rollers for unwinding the film web from the film web roll, a dancer roller for keeping the film web at a particular tension and one or more guiding rollers. In the apparatuses of FIGS. 1–4, 7 and 8, the axle 2 of the unwinder A extends parallel to the transport direction of the packaging apparatus 1 and the roll is arranged next to the packaging apparatus 1. In the schematic exemplary embodiment of FIG. 5, the roll holder axle 2 extends perpendicularly to the transport direction of the packaging apparatus 1 and the unwinder A is arranged in alignment with the packaging apparatus 1.

With the aid of the film guiding element 7, the film web F is guided in a horizontal plane over a transport path or conveyor belt 8 whose transport speed, in use, substantially corresponds to the speed of movement of the film F in the horizontal plane mentioned. Optionally, the conveyor belt 8 can be provided with suction openings and a vacuum chamber can be disposed below the upper conveyor belt, so that the film F is sucked to the conveyor belt 8 so as to limit slip between the conveyor belt 8 and the film web F to a minimum. Further, the packaging apparatus is provided with folding means 9 with the aid of which the longitudinal edges of the film web F are brought towards each other until the brought together longitudinal edges overlap for forming a continuous package tube. In the present exemplary embodiment, the folding means comprise the rods 9 which are clearly visible in FIGS. 1, 2, 7 and 8. Above the conveyor belt 8, at a short distance from or directly before a cross sealing device 11, a pulling device 10 is arranged, which, in the present exemplary embodiments, is designed as a pulling belt. However, it is also possible that this pulling device is formed by one or more rollers. Directly downstream of the pulling device 10, the earlier-mentioned cross sealing device 11 is arranged with the aid of which, transversely to the transport direction, cross seals are provided in the package tube between the successive products. FIG. 1 further clearly shows an input provision 14.

The appearance of the apparatus according to the invention deviates from the known apparatus shown in FIGS. 1 and 2 in that on top of the unwinder A, a stretching module B is arranged in which a first pair of drawing rollers 22 and a second pair of drawing rollers 23 are included. Moreover, in the apparatus according to the invention, the dancer roller is left out because the web tension is controlled in a different manner.

Figure 3:
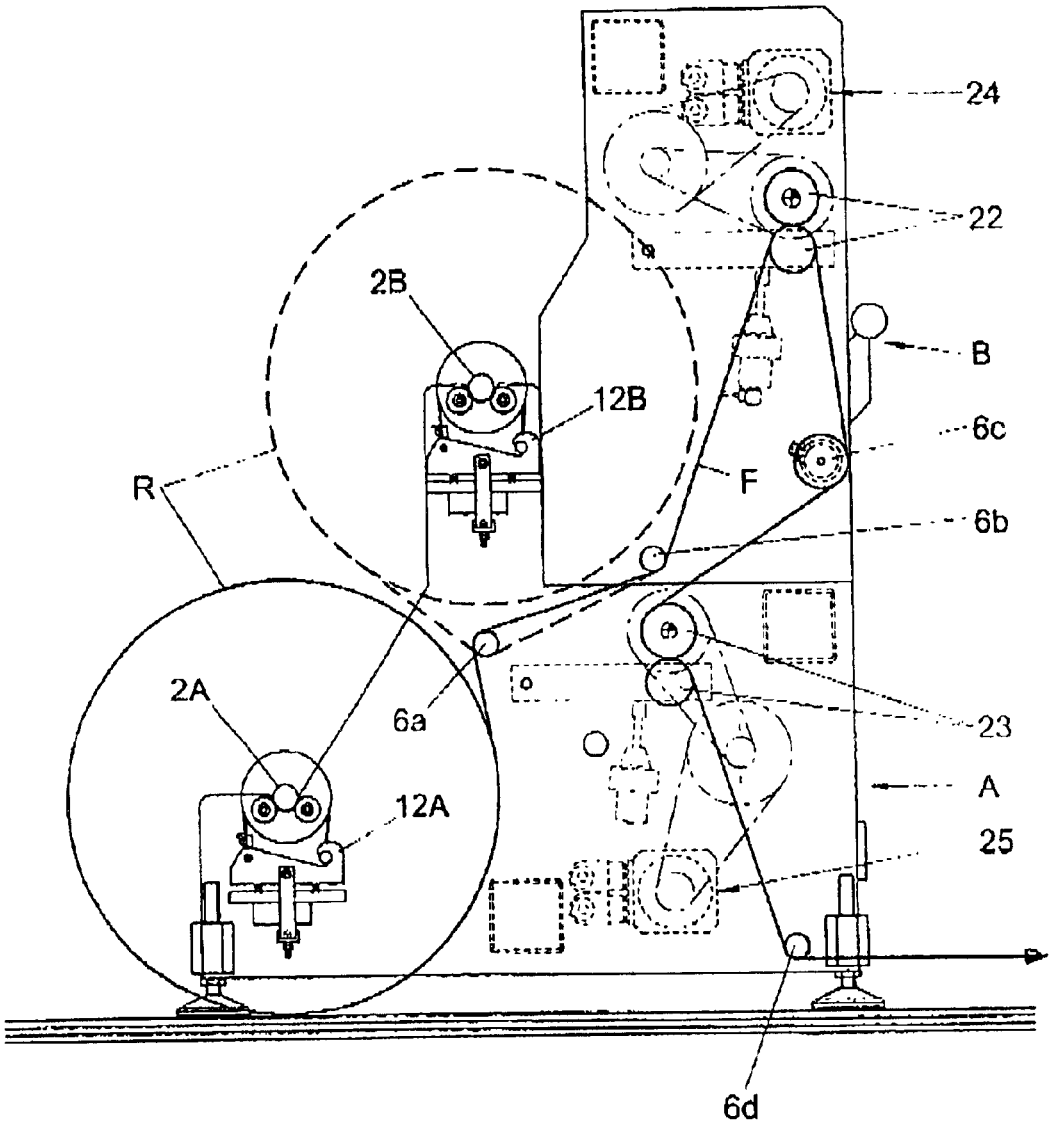
FIG. 3 shows a side view along line III—III of FIG. 2, wherein, on the unwinder, a stretching module has been placed.

As is clearly visible in FIG. 3, the film web F is guided from the film web roll over two guiding rollers 6*a*, 6*b* to then be guided between the first pair of drawing rollers 22. Then, the film web F is guided over a third guiding roller 6*c* and between the second pair of drawing rollers 23. From the second pair of drawing rollers 23, via a fourth guiding roller 6*d*, the film web is fed into the packaging apparatus, while the film web F passes a guiding roller 5 and, optionally, a fourth guiding roller 6*d*, to be transported from that location to the film guiding element 7 (see FIG. 5).

FIG. 3 also clearly shows that the unwinder with stretching module has two positions 2A, 2B for placing a film web roll R. In that manner, rapidly, a new film web can be fed into the packaging apparatus when one of the rolls is empty. The fact is that, already, a second film web roll can be put ready before the first film web roll has completely unwound. In that manner, a considerable reduction of exchanging time is obtained. With the interrupted line, the path is indicated along which the film web F extends when it is unwound from the top film web roll. FIG. 3 also clearly shows the servodrive 24 of the first pair of drawing rollers 22 as well as the servodrive 25 of the second pair of drawing rollers 23. Also visible in FIG. 3 are the brakes 12A and 12B, which prevent the rolls R from continuing to rotate when the packaging apparatus is stopped.

Figure 4:
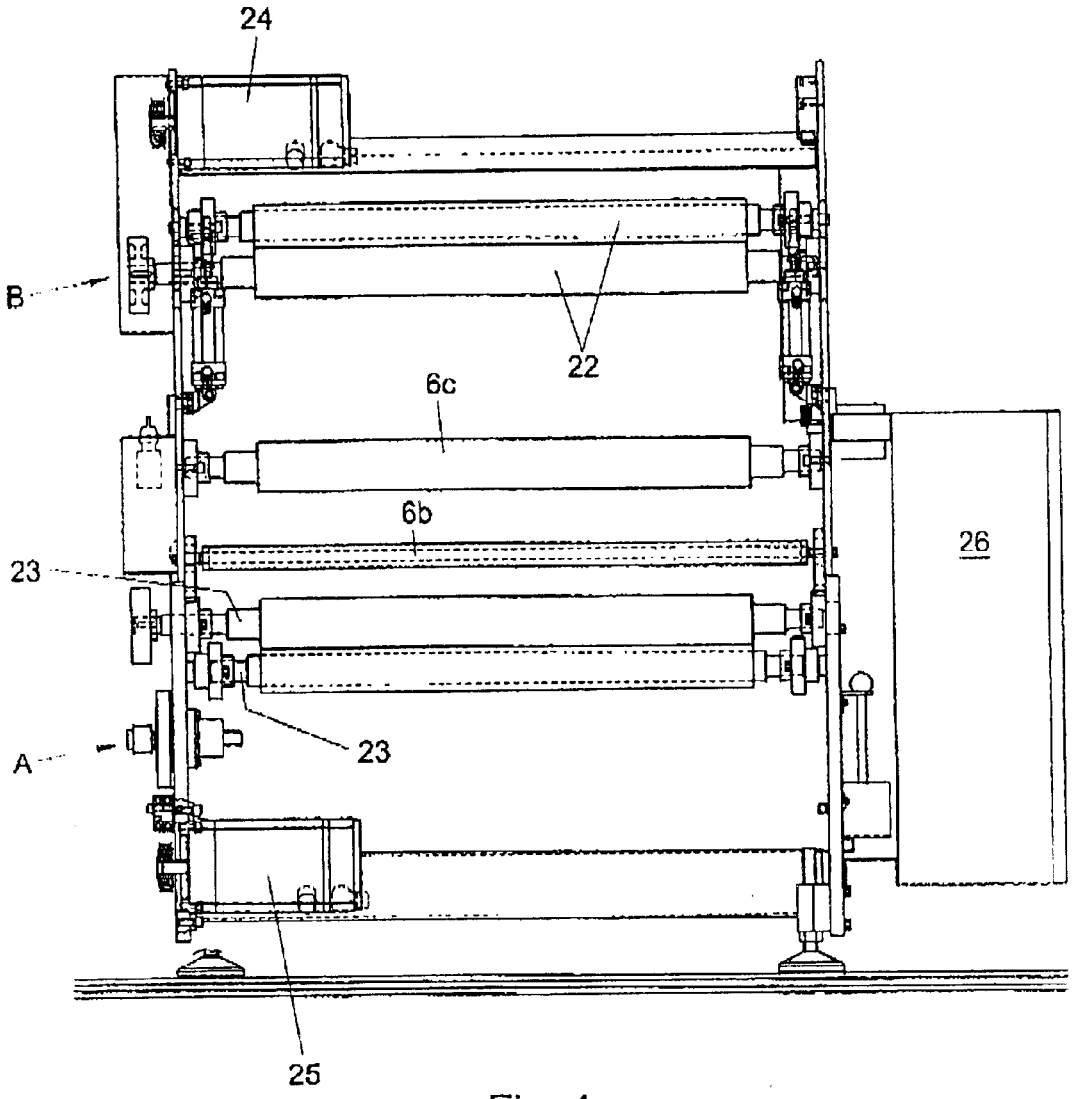
FIG. 4 shows a front view from line IV–IV of FIG. 2 of the unwinder with stretching module shown in FIG. 3.

FIG. 4 further shows the unwinder with the stretching module disposed thereon in front view, while with the same reference numerals as in FIG. 3, corresponding parts are indicated. Also, in FIG. 4, a control housing 26 is clearly visible.

For obtaining a tight-fitting film package with an attractive appearance, for instance Low Density Polyethylene can be used as a film, while the lengthening with respect to the original length is in the range of 5% to 30%, preferably in the range of 5% to 15%.

Figure 5:
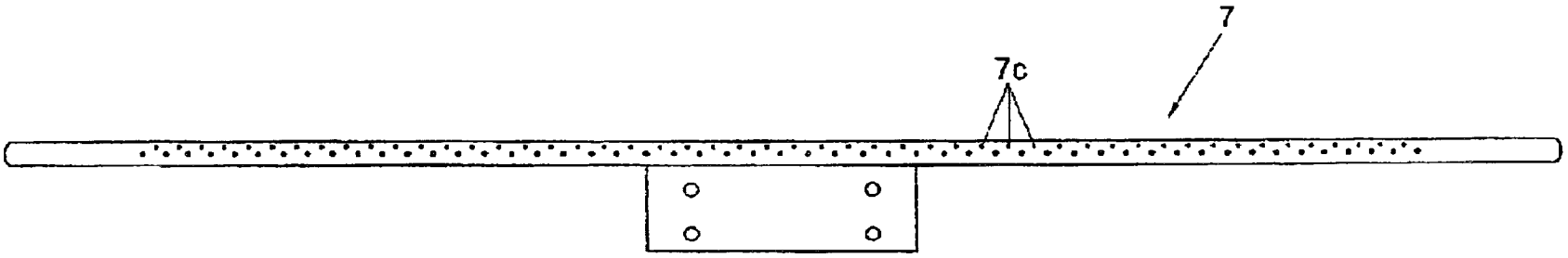
FIG. 5 shows a front view for a film guiding element destined for use in an apparatus according to the invention.
Figure 6:
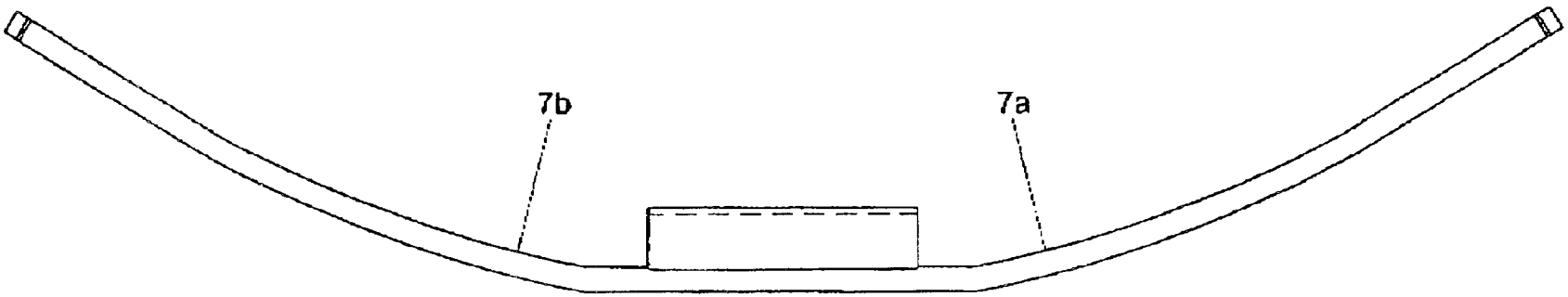
FIG. 6 shows a top plan view of the film guiding element shown in FIG. 5.

FIG. 5 shows a front view of the film guiding element 7 which is used in the present exemplary embodiment. The film guiding element 7 is provided with a tube having two bent extremities 7*a*, 8*b*. The tube is provided with holes 7*c*. In mounted condition, the tube is connected to a compressed air device such that compressed air flows out via the small holes 7*c*. FIG. 6 shows a top plan view of the film guiding element 7 represented in FIG. 5. In spite of the fact that the force with which the film web F is drawn against the film guiding element is great, with such a film guiding element 7, the friction between the film web F and the film guiding element 7 is relatively small. In particular when starting the packaging process, this is of great importance because then, stick/slip problems hardly occur at the film guiding element 7.

Figure 7:
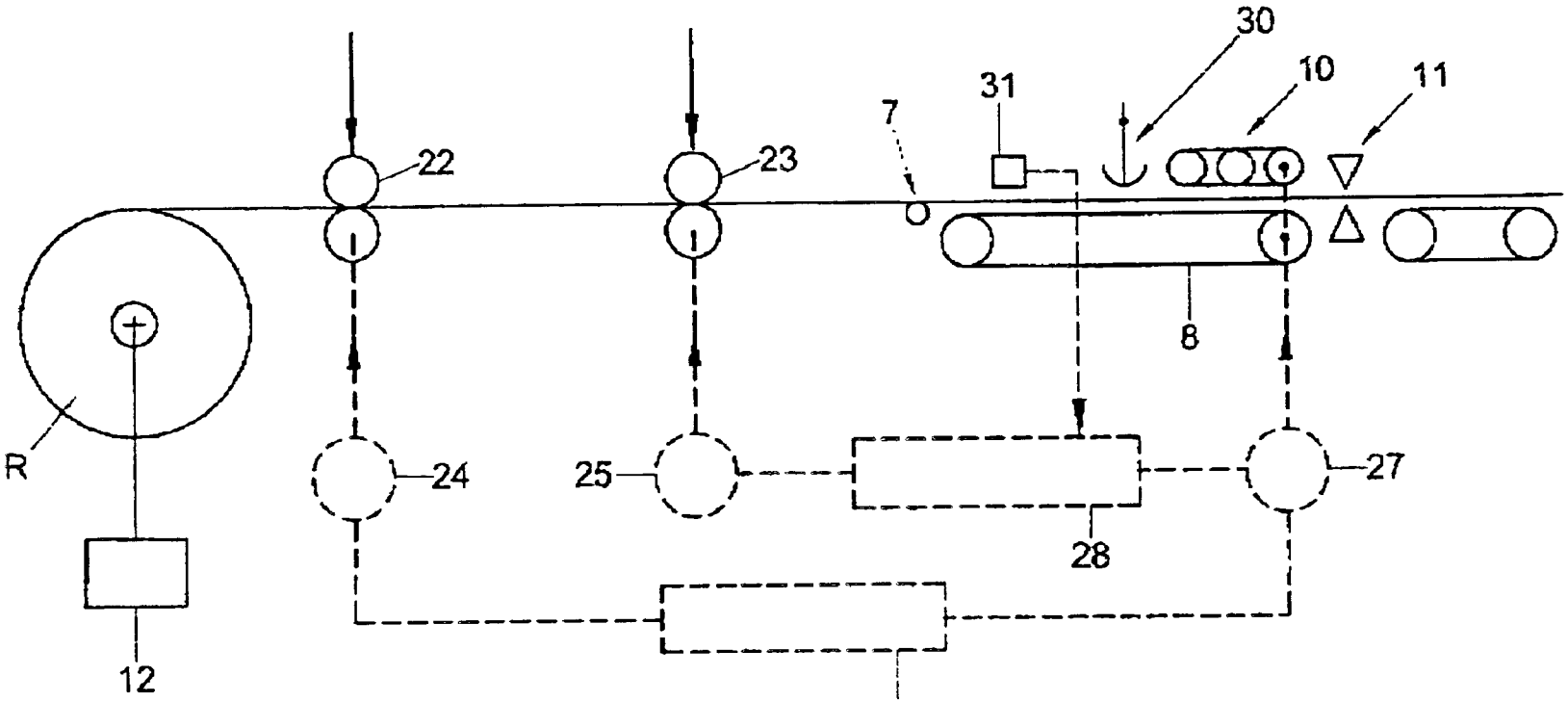
FIG. 7 schematically shows a first exemplary embodiment of a possible control diagram of an apparatus according to the invention.
Figure 8:
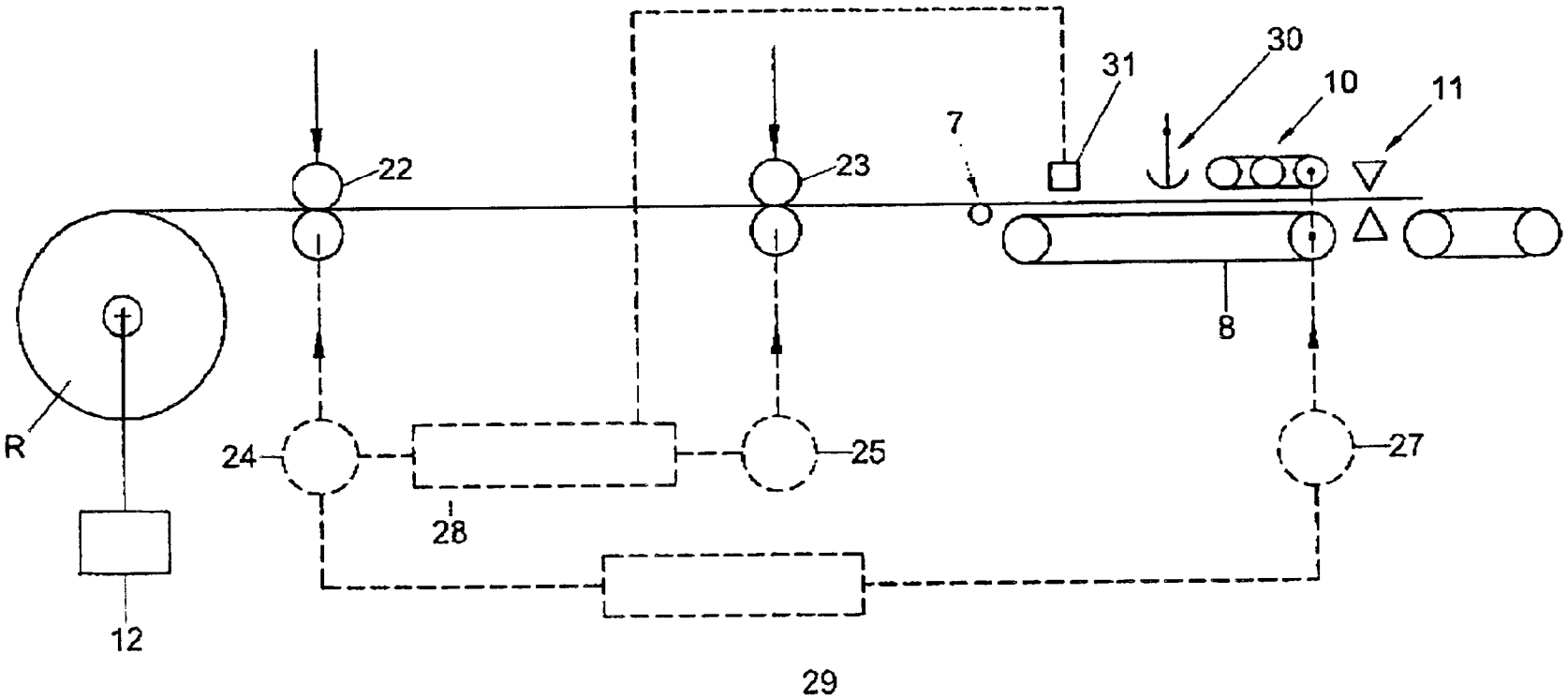
FIG. 8 schematically shows a second exemplary embodiment of a possible control diagram of an apparatus according to the invention.
Figure 9:
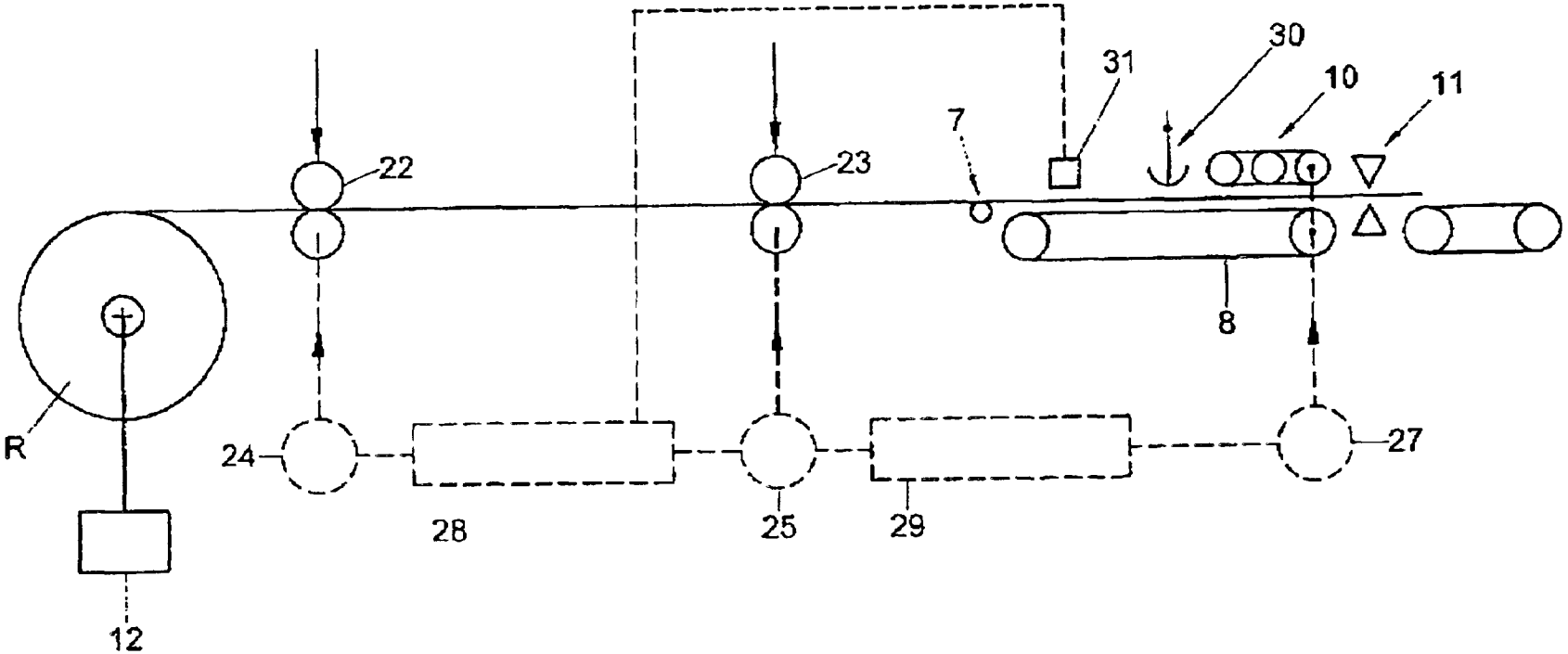
FIG. 9 schematically shows a third exemplary embodiment of a possible control diagram of an apparatus according to the invention.

FIGS. 7–9 schematically show different variants of control of the drives 24, 25, 27 of the first pair of drawing rollers 22, the second pair of drawing rollers 23 and the assembly of the transporter 8 and the pulling device 10, respectively, which last two are driven by a common, third drive 27. Highly schematically, the film web roll R, the brake 12 of the unwinder, the film guiding element 7 and the cross sealing device 11 are represented. Although the film web F in FIGS. 7–9 is represented as a straight line, it should be pointed out that this has only been done for the purpose of the schematic representation; in practice, the film web F will run from a bottom side to the film guiding element 7 and be guided over the film guiding element 7 in the horizontal plane. FIGS. 7–9 further show the longitudinal sealing device 30 which is also visible in FIG. 1 and which serves for interconnecting the longitudinal edges of the film web F. Further, a sensor 31 is indicated, provided directly downstream of the film guiding element 7. The signals of the sensor 31 are guided to the control module 28 of the control 32. The sensor serves for detecting a register mark applied to the film web F. On the basis of the register mark, the products are put on the film web. As the sensor 31 is arranged downstream of the film guiding element 7, the risk of products still shifting relative to the register mark is reduced to a minimum. The fact is that the sensor 31 is located in an area of the film web F in which the film web F is in a substantially stable condition.

In the exemplary embodiment of FIG. 7, via the first control module 28, the second drive 25 is coupled to the third drive 27. The third drive 27 in its turn is coupled via the second control module 29 to the first drive 24. In the exemplary embodiment of FIG. 8, the first drive 24 is coupled, via the first control module 28 to the second drive 25. Moreover, the first drive 24 is coupled, by the second control module 29, to the third drive 27. In the exemplary embodiment of FIG. 9, the first drive 24 is coupled, via the first control module 28, to the second drive 25. This second drive 25 in its turn is coupled, via the second control module 29, to the third drive 27. In all these variants, the control modules 28, 29 ensure that the ratio between the number of pulses guided to the various drives 24, 25, 27 is always equal. What is thus effected is that the degree of stretch between the pairs of drawing rollers 22, 23 is constant and that the degree to which the stretch is maintained, reduced or increased in the path between the second pair of drawing rollers 23 and the pulling device 10, is also constant. As the stretch can be set in two paths, the manner in which the total stretch is effected can be selected. For instance, between the two pairs of drawing rollers 22, 23, first, some additional stretch can be effected, which additional stretch is slightly relaxed in the path between the second pair of drawing rollers 23 and the pulling device 10. On the other hand, it is also possible that the stretch of the film in the path between the second pair of drawing rollers 23 and the pulling device 10 is slightly augmented. By varying these stretch ratios, the speed at which shrinkback takes place after the cross sealing device 11 as well as the degree of shrinkback can be influenced. A rapidly built-up stretch leads to a fairly rapid shrinkback, while a gradually built-up stretch leads to a somewhat slower shrinkback behavior. Moreover, the speed of stretching can also influence the degree of shrinkback of the film. This latter applies also for the duration in which the stretch is maintained. As a result of the presence of the two paths in which stretch can be effected and can be varied, the properties of the film can be taken into account such that the desired degree of shrinkage after the cross sealing device 11 occurs within a particular period of time. The fact is that generally, after the cross sealing device 11, the products will be stacked and be tautened by a tautening strap, so that free shrinkback can no longer take place. Therefore, the shrinkback process must have taken place before the tautening strap is provided around a newly formed stack of products.

Via the input provision 14, the degree of shrinkage, the package length and the optional overstretch can be made known to the control. However, it is also possible that the package length be derived from data known from the database as to the products to be packaged or from other settings of the apparatus relating to the package length, such as, for instance, the length of stroke of the cross sealing device. Generally, per product to be sent, the data base contains data about the annexes to include and therefore, potentially, has the length information of each product. Further, it is possible that the package length is measured with a sensor in the product-assembling path or directly behind the film guiding element, and is passed onto the control. Further, it is possible that the feeders in the product-assembling path are provided with sensors with the aid of which the length of a product present therein can be detected. Based on the package length, the desired shrinkage can be obtained. Optional overstretch or, conversely, understretch which is to take place in the first stretching path can be entered via the input provision. As these data are strongly dependent on the packaging material, the input could, for instance, comprise a description of the packaging material, from which the control itself then deducts to what degree overstretch or understretch is to take place in the first path.

Figure 10:
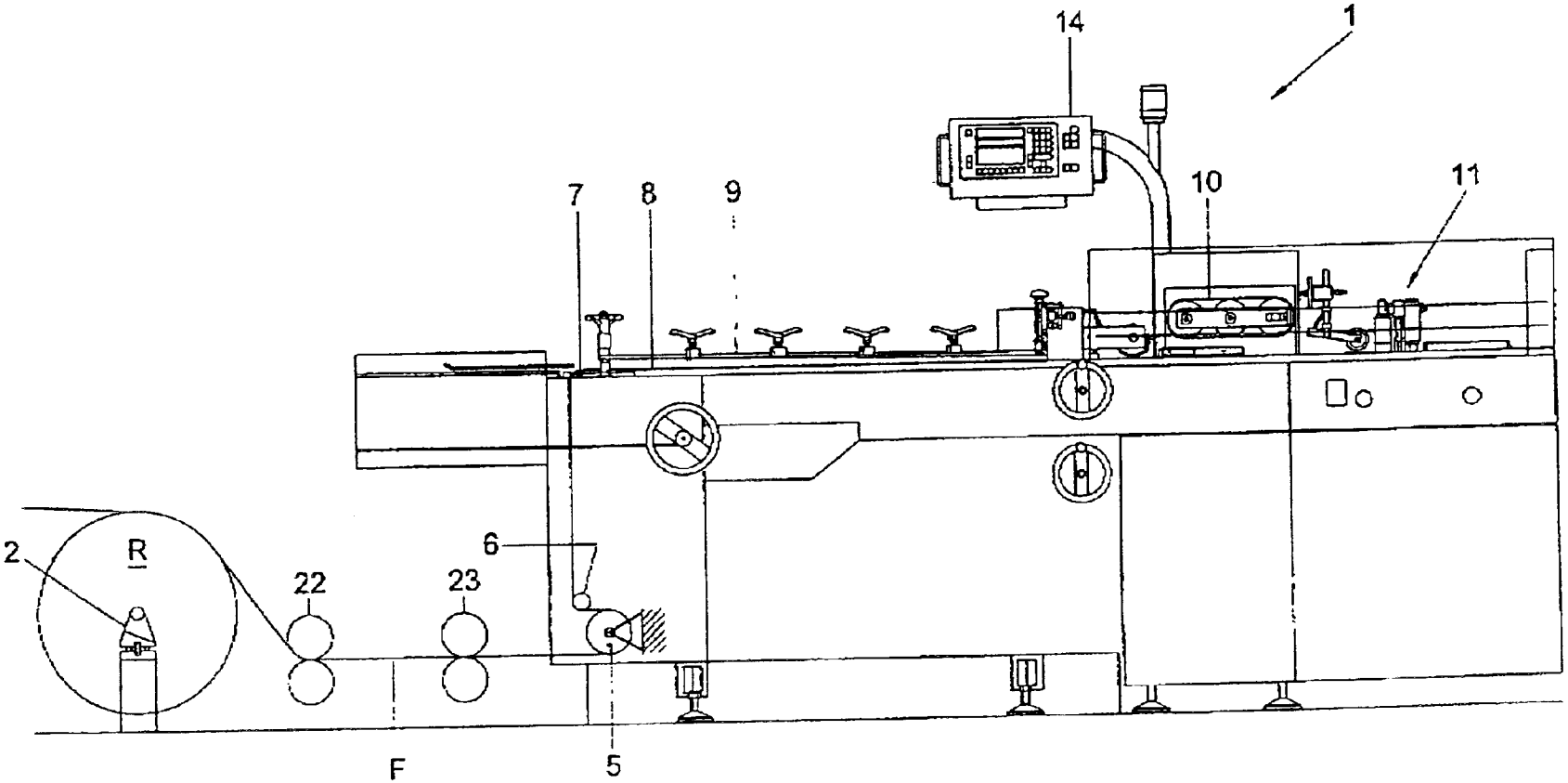
FIG. 10 shows a schematic side view of a second exemplary embodiment of the packaging apparatus.

FIG. 10 further shows a second exemplary embodiment of a packaging apparatus according to the invention, wherein the film web roll R is placed on an unwinder which is arranged in alignment with the packaging apparatus. Clearly visible in this Figure is the fixedly arranged guiding roll 5 which is not located in the unwinder but below the conveyor belt 8 in the packaging apparatus 1. In the conventional, known apparatus, this was the location of the dancer roller. Further, the first and the second pair of drawing rollers 22, 23, respectively, are clearly shown. Once again, it is emphasized that the representation in FIG. 10 is of a schematic character.

Figure 11:
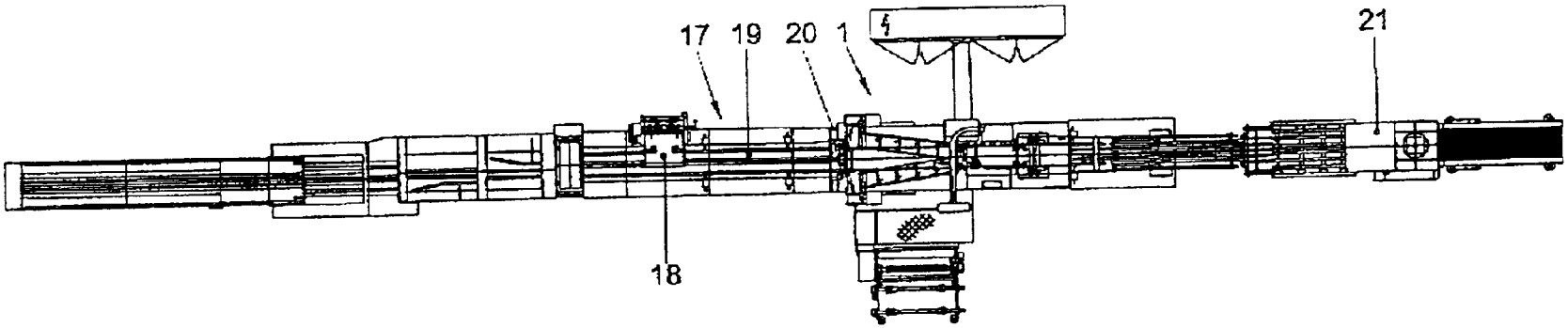
FIG. 11 shows a side view of a packaging line.
Figure 12:
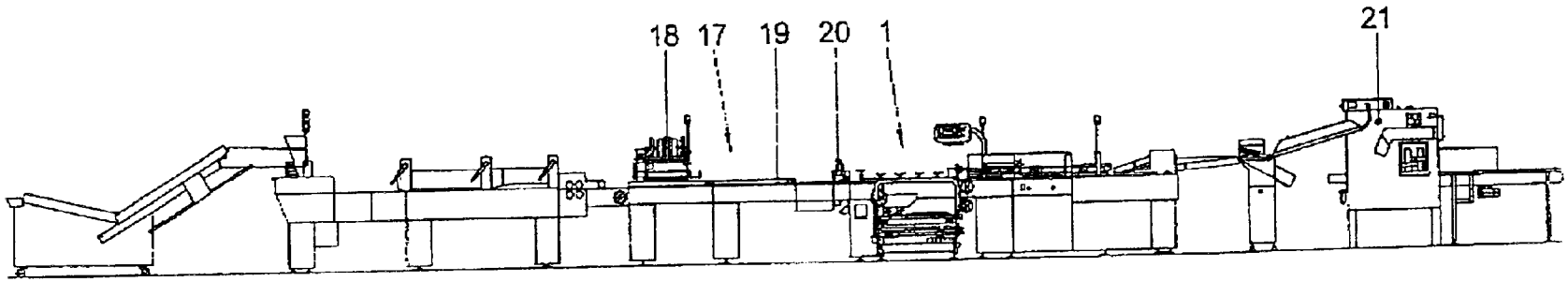
FIG. 12 shows a top plan view of the packaging line represented in FIG. 10.

Further, FIGS. 11 and 12, respectively, show a top plan view and a side view of a packaging line in which a packaging apparatus 1 according to the invention is included. The packaging line further comprises a product-assembling device 17 arranged upstream of the film guiding element 7 and which is provided with a number of feeders 18 and a product conveyor 19. The feeders 18 are designed for feeding subproducts to the product conveyor 19 for forming multi layer products, often consisting of a number of subproducts. Upstream of the packaging apparatus 1 and downstream of the product-assembling device 17, a product-positioning station 20 is provided for positioning, in a controlled manner, products dispensed by the product-assembling device 17 on the film web F in the packaging apparatus 1. Downstream of the packaging apparatus 1, a stacking station 21 for stacking the packaged products is provided. It will be clear that the packaging line and the packaging apparatus shown are particularly destined for packaging graphical products in film, such as magazines and newspapers, optionally while adding different types of products such as, for instance, CDs, cassettes and the like.

It will be clear that the invention is not limited to the exemplary embodiments described but that various modifications are possible within the framework of the invention and as defined by the claims.

What is claimed is:

1. A method for the use of a packaging apparatus, wherein the packaging apparatus is provided with folding means for bringing the longitudinal edges of a continuous moving film web towards each other, the two longitudinal edges, brought towards each other, overlapping for forming a continuous package tube, while downstream of the folding means a cross sealing device is provided with the aid of which, transversely to the transport direction, cross seals are provided in the package tube, while upstream of the folding means with the aid of two pairs of drawing rollers, the film is stretched such that after application of the cross seals, the film still shrinks in a longitudinal direction in order that packages are obtained in which the cross seals substantially abut against products packaged therein, so that the package extends relatively tight-fittingly around the products, said method comprising the steps of:

unwinding the film web from a film web roll which is placed on a roll holder of the packaging apparatus:

guiding the film web in a horizontal plane over a conveyor belt whose transport speed in use, substantially corresponds to the speed of movement of the film in the horizontal plane, while the film web is downstream of the two pairs of drawing rollers;

arranging a pulling device above said conveyor belt, directly, or at a limited distance upstream from the cross sealing device;

engaging the package tube with the pulling device at the location of the overlapping edges; and holding the film in a stretched condition with the aid of the pulling device, while the film is between the downstream pair of drawing rollers and the pulling device.

2. The method according to claim 1, wherein the upstream pair of drawing rollers, the downstream trailing pair of rollers as well as the conveyor belt and the pulling device are each driven by a controllable drive, which drives are mutually coupled by control modules, which control modules control the mutual positions of the drives such that between the pairs of drawing rollers a desired stretch of the film is realized and that between the downstream pair of rollers and the pulling device a particular degree of stretch of the film is maintained.

3. The method according to claim 1 or 2, wherein the film web is guided over a film guiding element for bringing the film into the horizontal plane of the conveyor belt, the film guiding element being designed as a tube provided with small holes, the tube being connected to a compressed air device such that compressed air flows out of the small holes and the friction between the film guiding element and the film web is minimized.

4. The method according to claim 3, wherein downstream of the film guiding element a sensor detects a register mark applied to the film web and, upon detection of the register mark, passes on a signal to a control, while the control controls the drives via the control modules such that the register mark is positioned relative to the products to be packaged in the desired manner.

5. The method according to claim 2, wherein, for determining the rotation of the first pair of drawing rollers, the second pair of drawing rollers as well as the conveyor belt and the pulling device, the respective drives are controlled by the control modules with the aid of pulses, the ratio between the number of pulses given off to the respective drives being always kept constant.

6. The method according to claim 1, wherein a control is provided with an input provision, wherein, via the input provision, an operator enters the desired package length before shrink-back and the degree of shrinkage and, optionally, a desired overstretch or understretch, or enters the packaging material, while this inputted package length, degree of shrinkage and optional overstretch or understretch is also an input signal of a control module.

7. The method according to claim 1, wherein the lengthening of the film web relative to the original length is in the range of 5% to 30%.

8. The method according to claim 1, wherein, as a film a Low Density Polyethylene is used.

9. The method according to claim 1, wherein the lengthening of the film web relative to the original length is in the range of 5% to 15%.

10. A packaging apparatus including means for practicing the method according to claim 1, the packaging apparatus comprising:

folding means for bringing the longitudinal edges of the film web towards each other, the two longitudinal edges overlapping for forming a continuous package tube;

a cross sealing device located downstream of the folding means, with the aid of which cross seals extending transversely to the transport direction are provided in the package tube;

a second pair of drawing rollers located upstream of the folding means and a first pair of drawing rollers located upstream of the second pair of drawing rollers for, viewed in the direction of movement of the film web before the folding means, extending the film in longitudinal direction, such that after application of the cross seals the film still shrinks in longitudinal direction in order that packages are obtained in which the cross seals substantially abut against the products packaged therein, so that the package extends relatively tight-fittingly around the products;

an unwinder onto which a film web roll can be placed;

a conveyor belt whose transport speed, in use, substantially corresponds to the speed of movement of the film in the respective transport plane;

a pulling device is arranged above said conveyor belt, directly or at a limited distance upstream form the cross sealing device, said pulling device engaging the package tube at the location of the overlapping longitudinal edges, wherein the first pair of drawing rollers is provided with a first drive, wherein the second pair of drawing rollers is provided with a second drive, wherein the conveyor belt and/or the pulling device are provided with at least a third drive, wherein a control is provided with control modules arranged for controlling the mutual positions of the respective drives, such that a stretch is realized not only between the pairs of drawing rollers and a particular degree of stretch is maintained between the second pair of drawing rollers and the pulling device.

11. The packaging apparatus according to claim 10, wherein at an upstream end of the conveyor a film guiding element is arranged for bringing the film into the horizontal plane of the conveyor belt, the film guiding element being designed as a tube provided with small holes, the tube being connected to a compressed air device, such that compressed air flows out of the small holes and the friction between the film guiding element and the film web is minimized.

12. The packaging apparatus according to claim 10 or 11, wherein downstream of the film guiding element a sensor is arranged, which sensor is designed for detecting a register mark applied to the film web and, upon detection of the register mark, passing on a signal to the control, the control being arranged for controlling the drives via the control modules, such that the register mark is positioned in the desired manner relative to the products to be packaged.

13. The packaging apparatus according to claim 10, wherein the control is provided with an input provision designed to either input the desired package length after shrinking back or the degree of shrinkage, wherein these inputted package length or degree of shrinkage is also an input signal of a control module.

14. The packaging apparatus according to claim 10, wherein, for determining the rotation of the first pair of drawing rollers, the second pair of drawing rollers as well as the conveyor belts and the pulling device (10), the respective drives are controlled by the control modules with the aid of pulses, wherein the ratio between the number of pulses given off to the various drives is always kept constant.

15. The packaging line comprising a packaging apparatus according to claim 10, wherein upstrearm of the film guiding element a product-assembling device is provided, comprising a number of feeders and a product conveyor, the feeders being designed for feeding subproducts to the product conveyor for forming multi layer products often consisting of a number of subproducts, wherein, upstream of the packaging apparatus and downstream of the product-assembling device a product positioning station is provided for positioning, in a controlled manner, the products dispended by the product-assembling device on the film web in the packaging apparatus.

16. The packaging line according to claim 15, wherein, downstream of the packaging apparatus, a stacking station for stacking the packaged products is provided.

17. The packaging line according to claim 15 or 16, wherein the products to be packaged comprise graphical products such as magazines and newspapers.

* * * * *